US010376728B2

(12) United States Patent
Newman

(10) Patent No.: US 10,376,728 B2
(45) Date of Patent: Aug. 13, 2019

(54) ADJUSTABLE TRAINING JUMP ROPE

(71) Applicant: David R. Newman, El Cajon, CA (US)

(72) Inventor: David R. Newman, El Cajon, CA (US)

( * ) Notice: Subject to any disclaimer, the term of this patent is extended or adjusted under 35 U.S.C. 154(b) by 373 days.

(21) Appl. No.: 15/376,643

(22) Filed: Dec. 12, 2016

(65) Prior Publication Data

US 2018/0161613 A1 Jun. 14, 2018

(51) Int. Cl.
*A63B 5/20* (2006.01)
*A63B 21/00* (2006.01)

(52) U.S. Cl.
CPC ..... *A63B 5/20* (2013.01); *A63B 21/4035* (2015.10); *A63B 2225/09* (2013.01)

(58) Field of Classification Search
CPC ..... A63B 5/20–205; A63B 21/00043; A63B 21/055–0557
See application file for complete search history.

(56) References Cited

U.S. PATENT DOCUMENTS

| | | | | |
|---|---|---|---|---|
| 4,872,666 | A | 10/1989 | Smith | |
| 5,224,910 | A | 7/1993 | Deutsch | |
| 6,544,148 | B1 | 4/2003 | Lowe | |
| 6,551,222 | B1 * | 4/2003 | Beaver | A63B 5/20 482/82 |
| 6,752,746 | B1 * | 6/2004 | Winkler | A63B 5/20 482/126 |
| 2003/0148859 | A1 * | 8/2003 | Chun | A63B 5/20 482/82 |
| 2010/0216608 | A1 * | 8/2010 | Veitch | A63B 5/20 482/82 |
| 2014/0080680 | A1 | 3/2014 | Henniger et al. | |
| 2015/0119206 | A1 | 4/2015 | Newman | |
| 2017/0028241 | A1 * | 2/2017 | Nurse | A63B 5/20 |

FOREIGN PATENT DOCUMENTS

CN 205379583 U 7/2016

OTHER PUBLICATIONS

International Search Report and Written Opinion for related International Application No. PCT/US2017/065880, dated Feb. 20, 2018, in 9 pages.

* cited by examiner

*Primary Examiner* — Jennifer M Deichl
(74) *Attorney, Agent, or Firm* — Procopio, Cory, Hargreaves & Savitch LLP; Lisel M. Ferguson

(57) ABSTRACT

At least one of two handles of an adjustable jump rope has an outer handle sleeve and an adjustment device releasably retained inside the handle sleeve which is configured to releasably retain a selected length of cable or rope in the handle sleeve so as to control the length of cable extending between the handles. The adjustment device may be an elongate stem having a plurality of spaced retainer devices for releasably retaining an enlarged end of the cable in the stem, so that the end of the cable can be engaged with different retainer devices to lengthen or shorten the cable length.

20 Claims, 10 Drawing Sheets

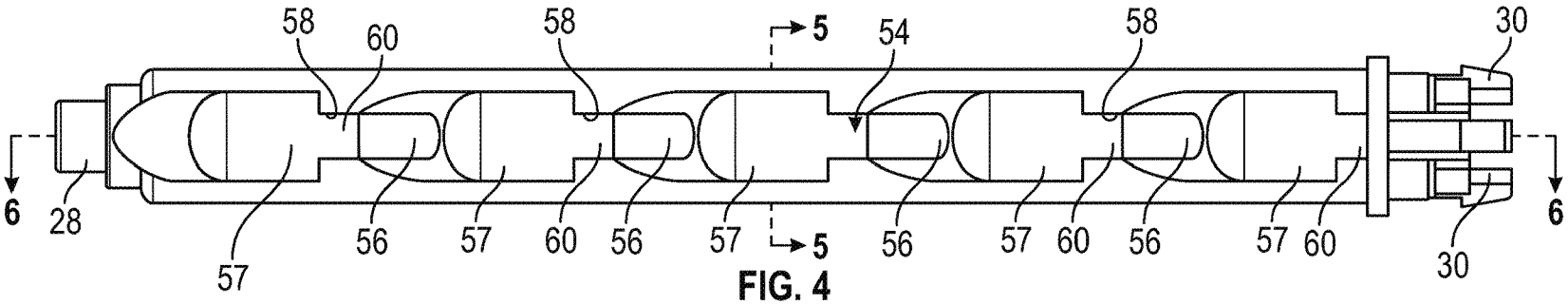
FIG. 4
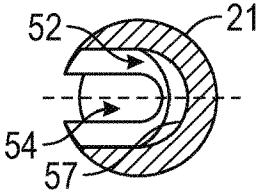
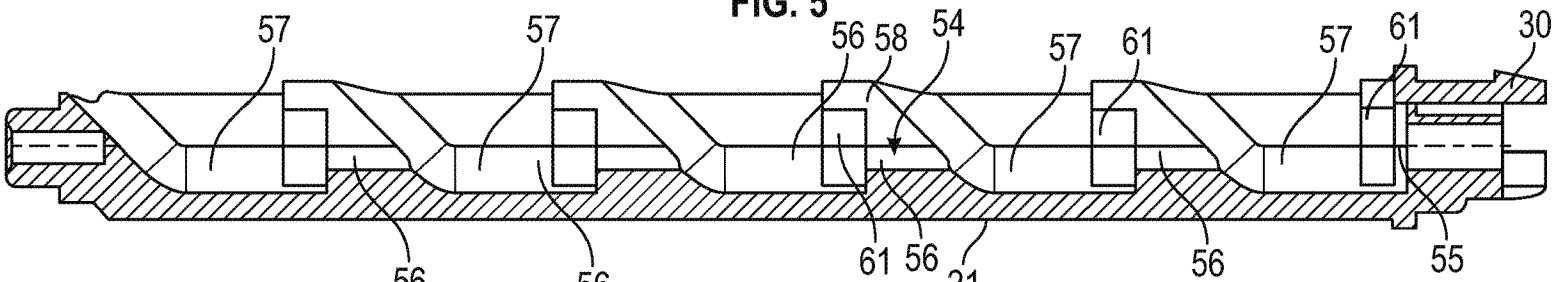
FIG. 5
FIG. 6

ADJUSTABLE TRAINING JUMP ROPE

BACKGROUND

Related Field

The subject matter discussed herein relates generally to jump ropes used for both exercise and play, and is particularly concerned with an adjustable training jump rope.

Related Background

Jump ropes generally consist of a rope or cable with handles at its opposite ends and are used for skipping by adults and children, both as a recreation or as a high performance aerobic or cardiovascular exercise. In my prior U.S. Pat. No. 9,320,932, a high performance exercise jump rope is described which comprises a cable attached at opposite ends to handles via a swivel assembly.

Skipping or jumping rope routines are common and popular for both play and exercise. In particular, athletes and others commonly use rope skipping or jumping in high performance exercise or workout routines for conditioning purposes. Jump rope exercising is also popular as a cross-training exercise which can be performed at different intensity and skill levels.

Jump ropes are provided at various different lengths according to a user's height, skill level, and type of exercise performed. For example, double under skipping requires sufficient clearance over the head when jumping, and freestyle requires even more clearance. In contrast, speed jumping for cardiovascular training requires a short cable or rope length. Beginners typically start with a relatively long rope, and progress to shorter ropes as their skill level increases. The better technique the user has, the shorter the rope needs to be.

SUMMARY

According to one aspect, an adjustable length jump rope is provided, which comprises a pair of handles and a cable extending between the handles and having opposite end portions associated with the respective handles. At least one of the handles has an outer handle sleeve and an adjustment mechanism in the sleeve for releasably securing different lengths of the associated cable end portion in the handle sleeve so as to adjust the length of rope extending between the handles. In one embodiment, both handles include a cable length adjustment mechanism for releasably securing selected lengths of the associated cable end portions in the respective handles to provide a greater range of adjustment in cable length.

The adjustability reduces the need for custom sizing of jump ropes based on different user skill levels and allows the exerciser to use one jump rope for a range of activities from speed jumping to double under or freestyle which require longer cable or rope length. It also allows the user to readily adjust the length based on their height and for different grip positions, or for different skill levels when performing more difficult jump rope exercises.

In one embodiment, one or both handles comprise a handle sleeve or casing having first and second ends, and a respective adjustment mechanism in each handle sleeve comprises an elongate stem releasably latched in the handle sleeve via a push button release mechanism or the like. In one aspect, the cable has a lug or retention head at one or both ends. The stem has a series of spaced retention formations configured to releasably retain the head at an end of the cable, with the cable extending from the head out of the second end of the handle. The head can be moved to a different retention formation in order to increase or decrease the length of cable inside the handle and thus vary the cable length between the handles.

Other features and advantages will become more readily apparent to those of ordinary skill in the art after reviewing the following detailed description and the accompanying drawings.

BRIEF DESCRIPTION OF THE DRAWINGS

FIG. 4 is a top plan view of the adjustment stem of FIG. 3;

FIG. 5 is a cross-sectional view on the lines 5-5 of FIG. 4;

FIG. 6 is a cross-sectional view on the lines 6-6 of FIG. 4;

DETAILED DESCRIPTION

Figure 1:
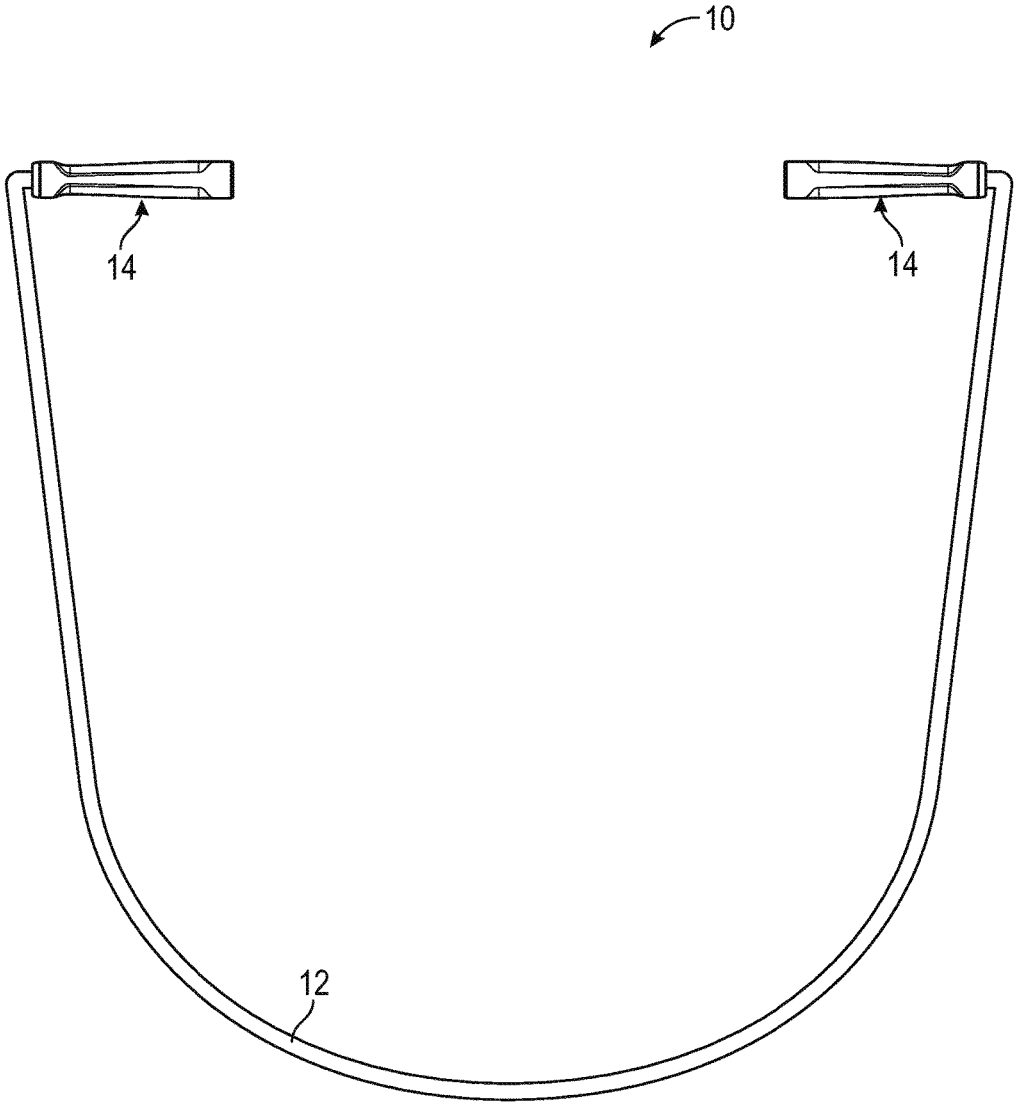
FIG. 1 is a front view of one embodiment of an adjustable jump rope or training jump rope device.
Figure 2:
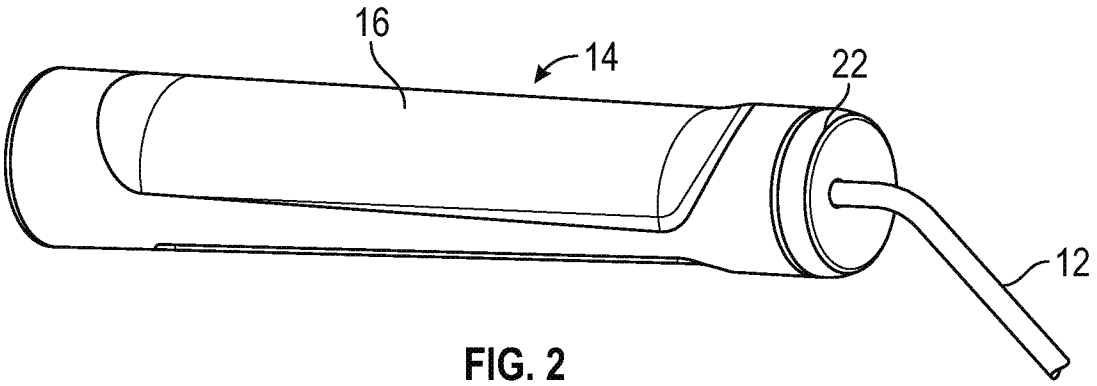
FIG. 2 is a perspective view of an adjustable handle of the jump rope of FIG. 1.

The subject matter described herein is taught by way of example implementations. Various details have been omitted for the sake of clarity and to avoid obscuring the subject matter. The examples shown and described below are directed to an adjustable training rope or jump rope which is readily adjustable in length by a user based on skill level, from a longer length for beginners to successively shorter lengths when the user becomes more skilled and can attempt more difficult routines.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

FIGS. 1 to 15 illustrate an adjustable jump rope or device 10 which comprises first and second handles 14 and a cable 12 extending between the handles and having opposite first and second end portions adjustably secured in the respective handles via a releasable adjustment mechanism to vary the cable length. Although both cable end portions are adjustably secured to the respective handle assemblies in the illustrated embodiment, in alternative embodiments only one handle assembly includes a cable length adjustment mechanism for one end portion of the cable, and the other end portion is not adjustable.

In the illustrated embodiment, each handle 14 comprises a handle sleeve or casing 16 and an adjustment mechanism or stem 20 telescopically engageable in the handle sleeve for releasably securing a selected length of the associated cable end portion inside the handle, whereby the length of rope extending between the handles is adjusted. The stem 20 is releasably secured in the handle sleeve by a quick release latching device or mechanism, as described in more detail below.

In one embodiment, an adjustable length of cable or rope 12 extends between the two handles 14 releasably coupled to respective opposite ends of cable 12. Cable 12 may be of any type typically used in jump ropes, and may be of varying construction, material or weight, such as rope, leather, nylon, braided steel, PVC coated stainless steel, and the like. As illustrated in FIGS. 3, 8, and 11 to 16, cable 12 has an enlarged retention member or head 15 secured at each end. Head 15 is adapted for attachment to stem 20 at a selected position, as described below. In the illustrated embodiment, the retention member 15 is an enlarged head or lug of cylindrical shape, but other configurations may be used in alternative embodiments.

Figure 3:
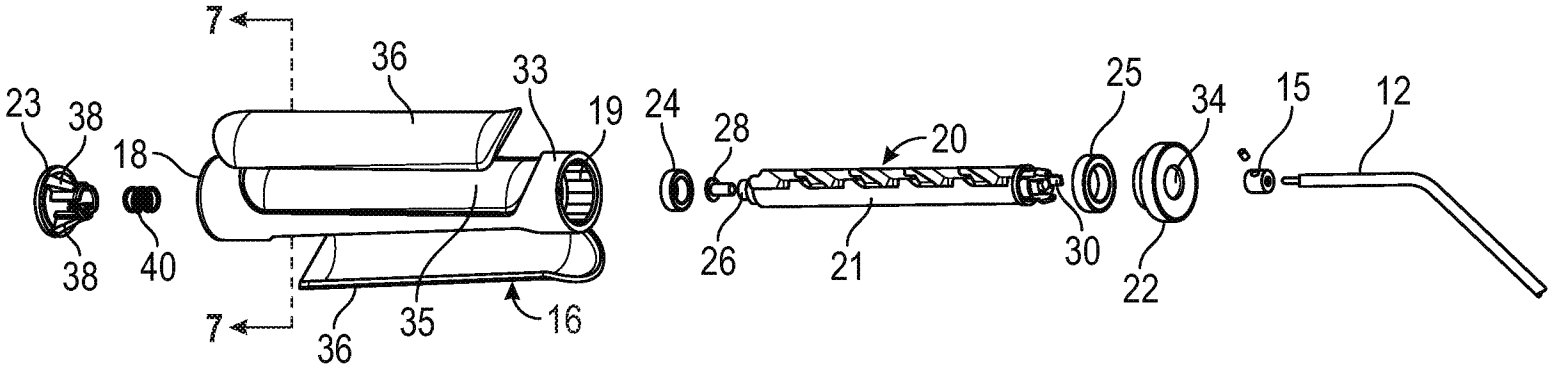
FIG. 3 is an exploded perspective view illustrating the separated handle sleeve and adjustment stem components of the handle assembly of FIG. 2.
Figure 7:
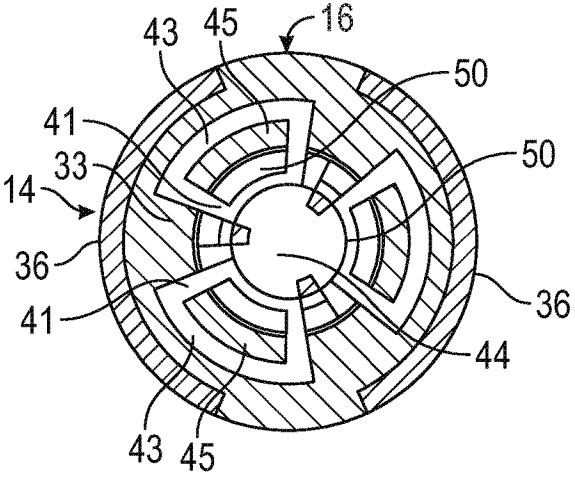
FIG. 7 is a cross sectional view of the assembled handle sleeve prior to insertion of the adjustment stem of FIGS. 4 to 6, taken on the lines 7-7 of FIG. 3.

One of the handles 14 is illustrated in more detail in FIGS. 2 to 9. Handle 14 basically comprises a handle sleeve or casing 16 having a first, distal end 18 and a second, proximal end 19, and an elongate stem 20 releasably latched in the handle via a push button quick release mechanism 23, 40 or the like. In one aspect, the cable has a lug or retention head 15 at one or both ends. The stem 20 basically comprises a stem body 21, bearings 24, 25 at opposite end of the stem body, and an end cap 22, as best illustrated in FIGS. 3 and 7. Stem body 21 has a series of spaced retention seats or formations configured to releasably retain the head at an end of the cable, as described in more detail below with reference to FIGS. 4 to 6 and 8. The cable extends from retained head 15 out of the proximal end of the handle. The head can be moved to a different retention formation in order to increase or decrease the length of cable inside the handle and thus vary the cable length between the handles.

Figure 8:
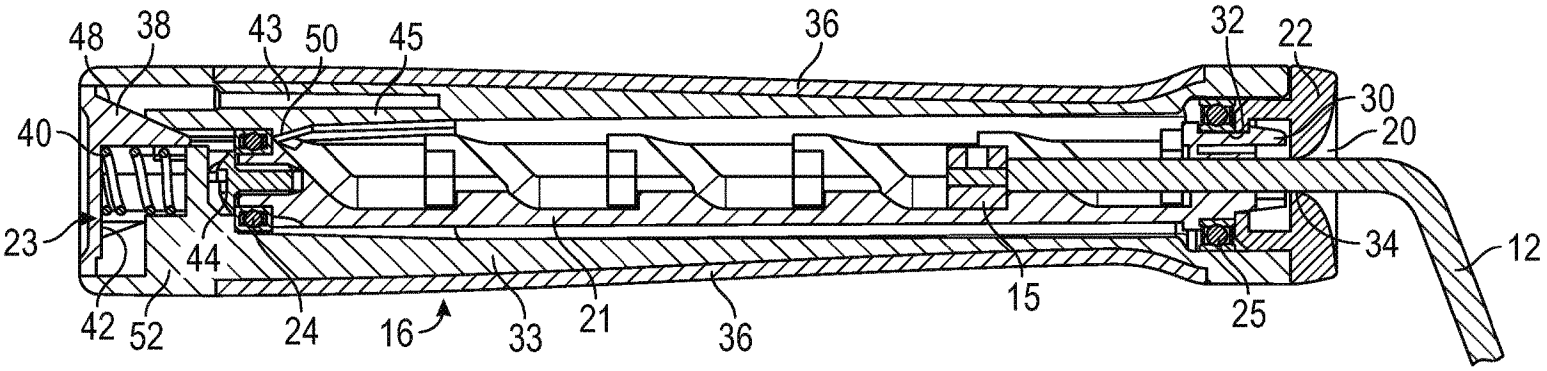
FIG. 8 is a longitudinal cross-section view of the assembled handle on the lines 8-8 of FIG. 2.
Figure 9:
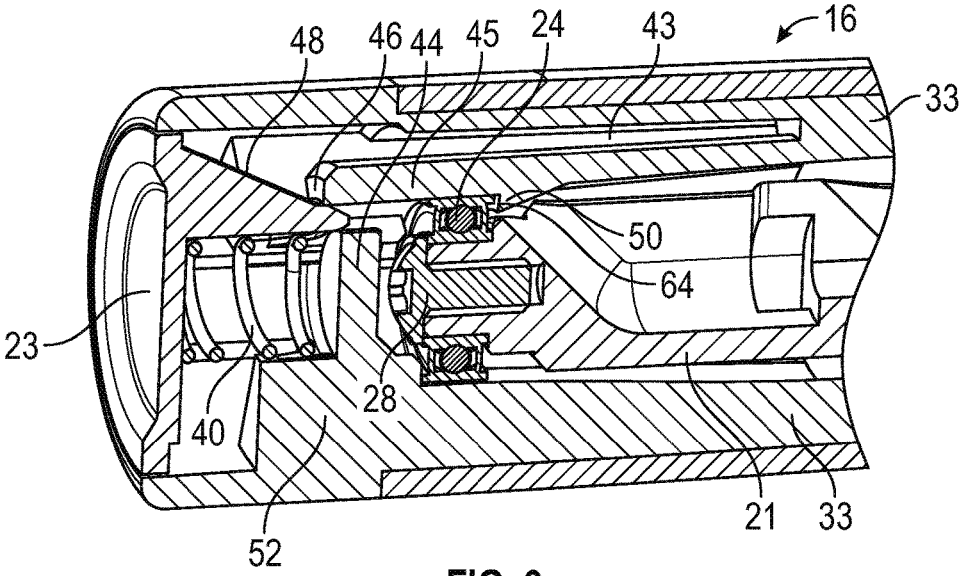
FIG. 9 is an enlarged cross-sectional view of the first end portion of the handle of FIG. 8, illustrating the latching mechanism between the handle sleeve and the inner stem.
Figure 10:
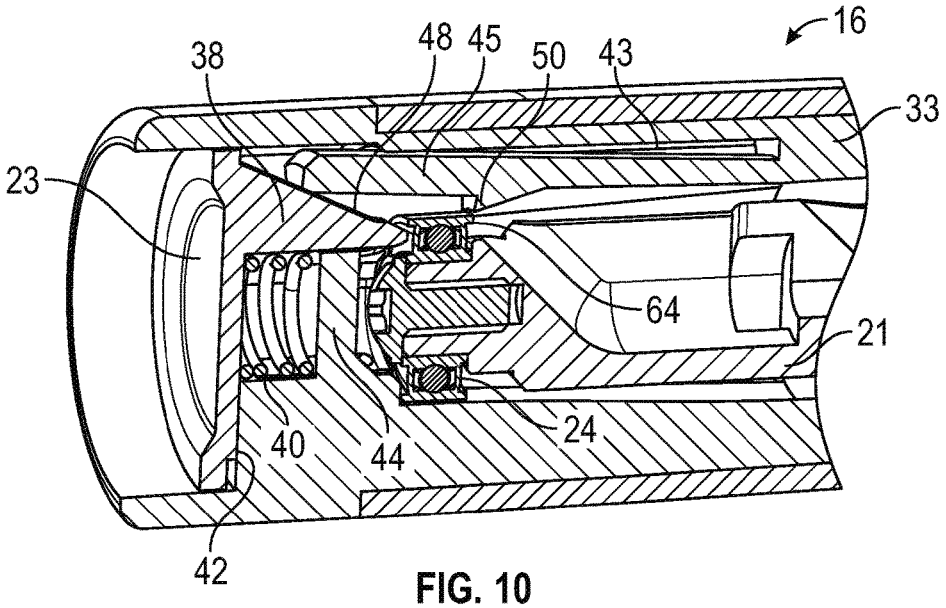
FIG. 10 is a view similar to FIG. 9 but illustrating the push button depressed to release the stem.

In the illustrated embodiment, the quick release mechanism comprises an end plug or push button 23 engaged in the distal end 18 of the sleeve which is configured to release a latching mechanism between the inner end of the stem 20 when depressed, as discussed in more detail below, and a spring 40 which biases the push button 23 into its outer position in sleeve 16. End cap 22 of stem 20 is a push fit in an enlarged diameter seat in the proximal end 19 of the sleeve when the stem is fully engaged in the handle sleeve as illustrated in FIGS. 8, 9 and 10. Bearings 24, 25 are engaged between respective opposite ends 26, 30 of stem body and push button 23 and end cap 22. The bearings allow for rotation of the stem and the attached rope end relative to the handle sleeve 16. Bearing 24 is engaged over reduced diameter end portion 26 of the stem body and secured to the stem body via screw 28. Bearing 25 engages over spring loaded retainer clips 30 projecting from the opposite end of stem 12, and the clips 30 extend through opening 32 at the inner end of cap 22 to secure the cap to the stem, as best illustrated in FIG. 8. Lug 15 and the attached end portion of cable 12 extend through a flexible outer opening 34 of cap 22 and into the stem, as described in more detail below.

As best illustrated in FIGS. 3 and 7, handle sleeve 16 has a main body 33 comprising a generally cylindrical member with opposing, elongate indents on 35 on opposite sides in which grip inserts 36 are secured. The main body may be of any suitable rigid material, such as polypropylene, and the grip inserts may be of silicone rubber or the like. The wall thickness of body portion 33 increases along its length in a direction towards the first end 18, and a reduced thickness end portion extending inward from end 18 forms a seat to receive the push button 23. A larger thickness portion 52 is provided adjacent the push button with an inwardly projecting stop face 44 and cut-outs as described in more detail below. Stem body 21 may be of plastic, nylon, or other material. As illustrated in FIGS. 3 and 8, push button 23 has a series of spaced angled projections or fingers 38 extending from inner surface 42. Biasing spring 40 extends between an inner face 42 of push button 23 and seat or stop 44 in the end of sleeve 16 so as to bias the push button towards the outer or retracted position of FIGS. 7 and 9, in which the stem is locked inside the handle sleeve. Stop 44 can also be seen in FIG. 7, which is a cross-sectional view of the handle sleeve 16 prior to insertion of the stem, taken on the lines 7-7 of FIG. 3.

A series of three spaced retainer clips 45 are formed integrally in the wall of sleeve 16 by spaced radial slots 41 and circumferential slots 43 between slots 41. Slots 41 and 43 extend inwardly from the outer end of wall portion 52, as best seen in FIGS. 7 and 9. Clips 45 have outer ends 46 which engage with tapered outer surfaces 48 of corresponding spaced angled projections 38 of push button 23. Each retainer clip also has a radially inward projecting catch or snap hook 50 which faces outwards and engages the inner end of bearing 24 in the latched position of FIGS. 8 and 9. The clips have some resilience to allow for snapping in and out of engagement with bearing 24, and are formed integrally in the interior surface of sleeve 16 in the illustrated embodiment, but separate clips with snap hooks may be secured to the sleeve in alternative embodiments.

In FIG. 8, the stem 20 is fully engaged and latched in the hollow shell ready for use while exercising with the jump rope. The user pushes the push button 23 inwards from the position in FIG. 9 to the position shown in FIG. 10 in order to release the stem 20 from the handle sleeve, for example in order to adjust the cable length. In the position shown in FIG. 9, the push button 23 is fully extended and located at the open end 18 of sleeve 16, with the spring 40 in a relaxed condition and the catches or snap hooks 50 of each of the three retainer clips 45 engaging the inner end of bearing 24 to retain the stem in the sleeve. In the position shown in FIG. 10, the button 23 is depressed, collapsing spring 40, and the projections or fingers 38 simultaneously move inwards so that the retainer clips are urged radially outwards by the engagement of the ends 46 of the clips with the outwardly tapered surfaces 48 of projections or fingers 38. This simultaneously moves the catches or hooks 50 outwards to release bearing 24 so that the stem 20 can be removed via the opposite end 19 of sleeve 16, as described in more detail below.

The adjustable cable retention mechanism in stem body 21 will now be described in more detail with reference to FIGS. 4 to 6. Stem body 21 has an open channel or groove 54 of varying width and depth formed along its length. One end wall of the channel has an opening 55 for receiving the end lug 15 and cable 12 into the channel. Channel 54 has narrower, shallower portions 56 sized to receive the cable 12 and alternating with wider, deeper portions 57 which are sized to receive end lug 15. Opposite side edges of the open end of the channel also have a series of opposing inward projections or tabs 58 defining narrower slots 60 and forming seats 61 designed to engage and trap the end lug in a selected adjustment position, as described in more detail below. Slots 60 are located at the transitions between each larger portion 57 and narrower portion 56 of the channel, as well as at the entrance end of the channel adjacent opening 55. Thus, the tabs 58 and slots 60 form a series of five spaced adjustment positions for the cable 12. A greater or lesser number of adjustment positions may be provided in other embodiments.

In one embodiment, the distance between each pair of seats 61 is around one inch or around 2.6 cm. Thus, the total length adjustment between the first seat 61 at the stem inlet and the final seat 61 closest to the opposite end 26 of the stem is four inches or about 10 cm. If both handle assemblies are adjustable as in the illustrated embodiment, a length adjustment of up to eight inches can be achieved. In some embodiments, only one handle assembly may incorporate a cable length adjustment mechanism, or longer handle assemblies may be provided for increased length adjustment if needed.

The procedure for adjusting cable length will now be described in more detail with reference to FIGS. 8 to 15. As noted above, FIGS. 8 and 9 illustrate the stem 20 held in the handle casing or sleeve 16 by the snap hooks 50, with spring 40 biasing the push button 23 to the outermost position. In order to release the stem, the user simply pushes button 23 inward, compressing spring 40 while the ends 46 of clips 45 are urged outward along tapered surfaces 48 of the push button projections 38 as they are pushed inward into the sleeve, as illustrated in FIG. 10. Once the snap hooks 50 are moved outwards to clear the bushing 24, the stem is released and the cap is urged back outwards by spring 40 into the end position.

Figure 11:
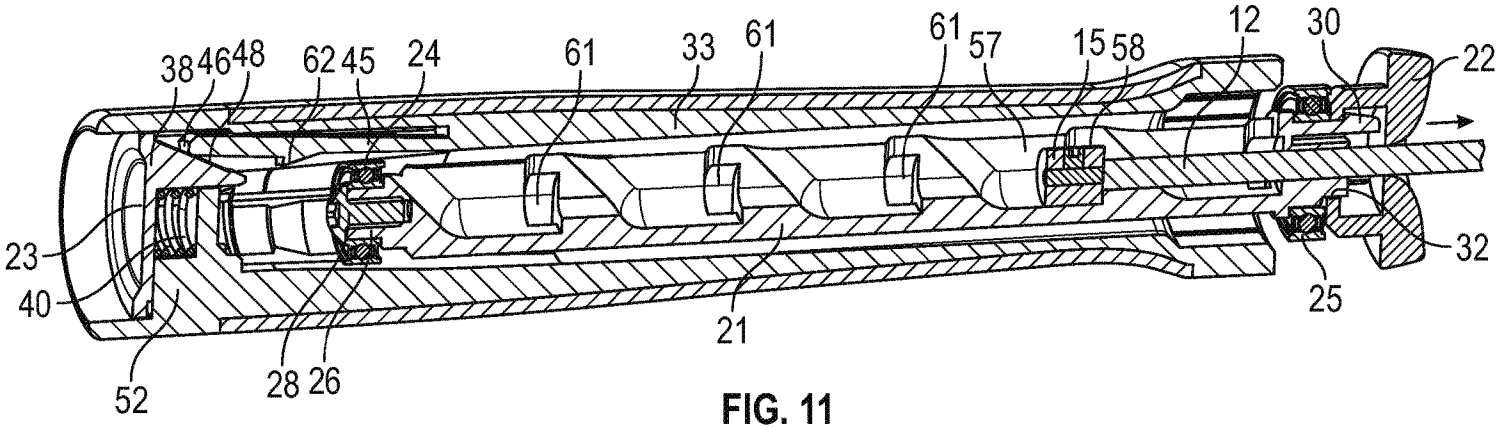
FIG. 11 is a longitudinal cross-section view of the handle illustrating a stage in removal of the stem from the handle sleeve.
Figure 12:
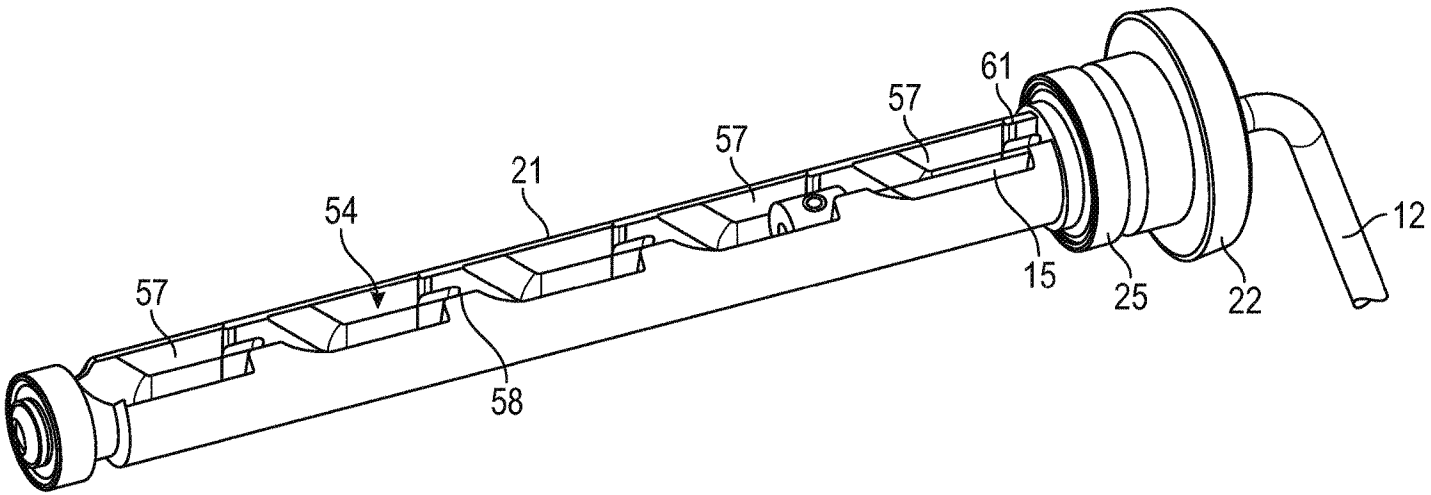
FIG. 12 illustrates the stem completely separated from the handle sleeve.
Figure 13A:
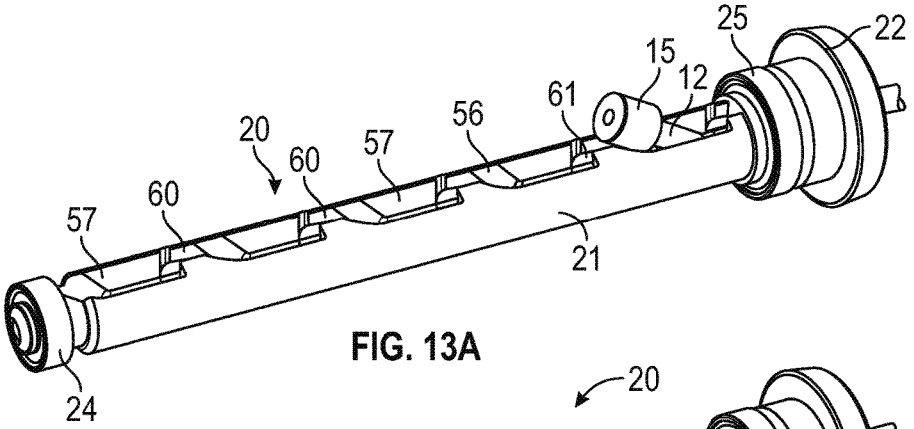
FIGS. 13A, 13B and 13C illustrate the stem with the rope or cable extending into the stem groove or channel at different adjusted positions for different cable lengths.
Figure 13B:
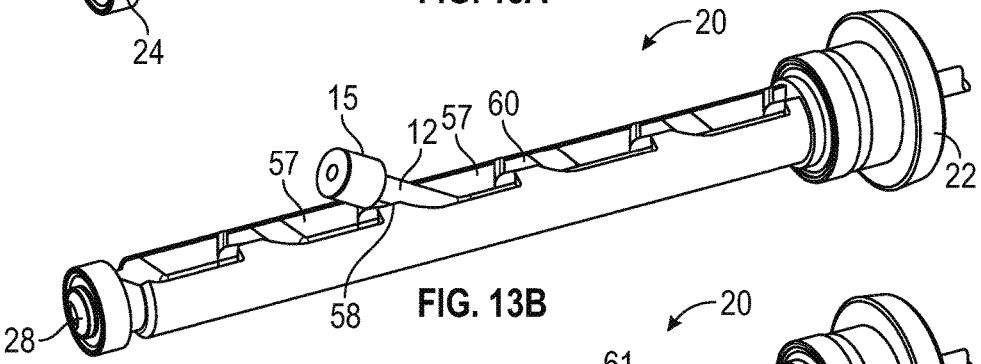
Figure 13C:
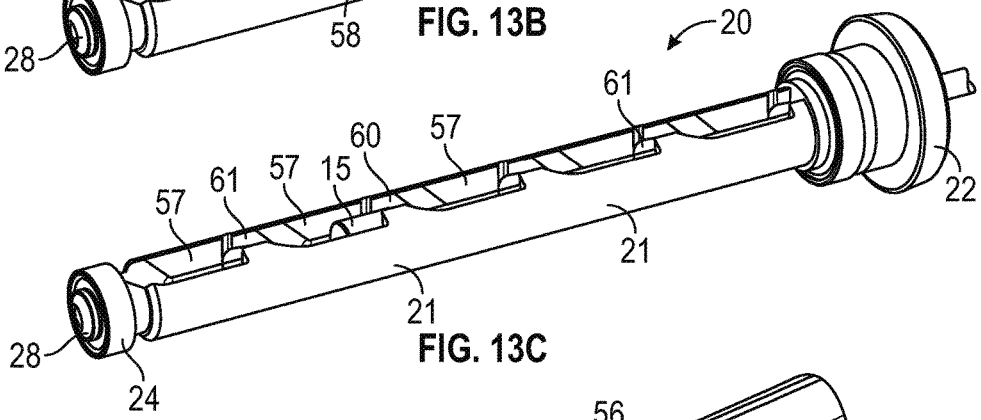

At the same time, the user pulls on part of cable 12 extending out of the handle end cap 22, pulling the stem out of the outer sleeve or shell 16 as indicated by the arrow in FIG. 11. Once the stem is completely separated from the handle sleeve or shell 16, as in FIG. 12, the cable length extending into the stem can be adjusted based on the skill level of the user or skipping exercise requirements. As indicated in FIG. 13A, the user first pulls the lug 15 rearwards out of the seat 61 and into the larger size channel portion 57 adjacent to seat 61. At this point, lug 15 can be pulled upward and out of the channel through the larger gap between opposite sides of the channel above channel portion 57 (see FIGS. 4 and 6), into the position illustrated in FIG. 13A. Cable 12 can then be pulled through the end cap either in an inward direction to reduce cable length for a more skilled user or an outward direction to increase cable length for a beginner. Once the desired amount of cable has been pulled through the end cap and the lug is positioned above a larger opening into the channel portion 57 adjacent a selected seat 61, the cable 12 is pushed down into the channel through the smaller slots 60 and seat 61, and the end lug 15 is pushed down into the larger channel portion 57 adjacent the seat 61. An example of this adjustment is shown for the fourth adjustment position in stem body 21 in FIGS. 13B and 13C. The user then pulls back on the cable outside the stem cap 22 to move the lug until it is trapped in seat 61 under retainer tabs 58 projecting from opposite edges of the channel at seat 61, as best illustrated the enlarged view of part of the stem body in FIG. 14. In the example illustrated in FIGS. 13A to 14, the cable is moved from the first seat or lug position adjacent end cap 22 corresponding to the longest cable length into a position three seats along the stem, so that the length of cable protruding from the stem is reduced by around three inches. If the same adjustment is made for both handle assemblies, the cable length is reduced by around 6 inches. The retention lug or head 15 may be similarly retained in any of the five seats 57 dependent on the desired cable or rope length.

Figure 14:
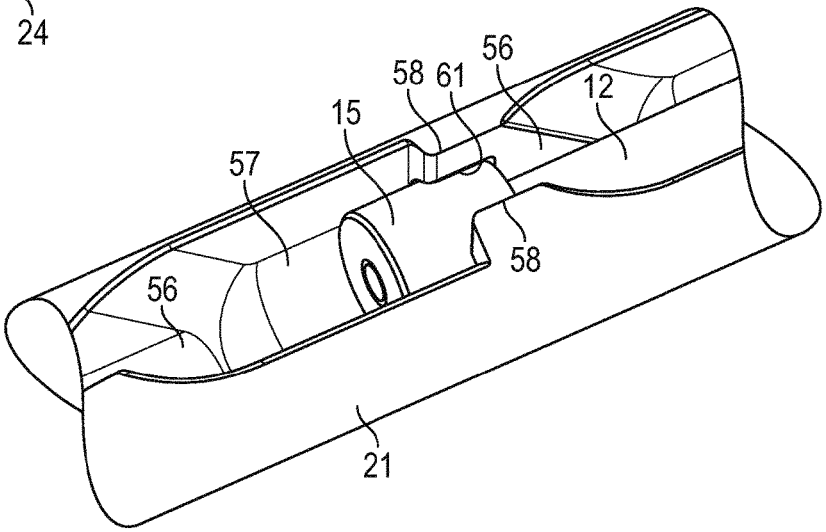
FIG. 14 is an enlarged view of the circled area in FIG. 13C illustrating the enlarged head or lug at one end of the cable engaged in one of the slots to hold the cable in a selected position in the stem.
Figure 15:
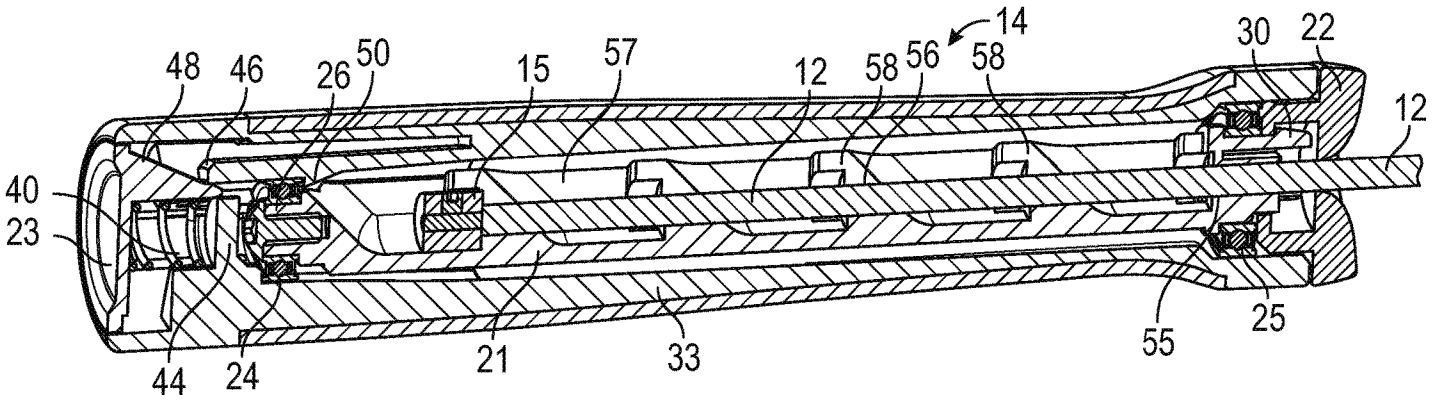
FIG. 15 is a longitudinal cross-sectional view of the assembled handle illustrating the cable secured in the shortest jump rope length position.
Figure 16:
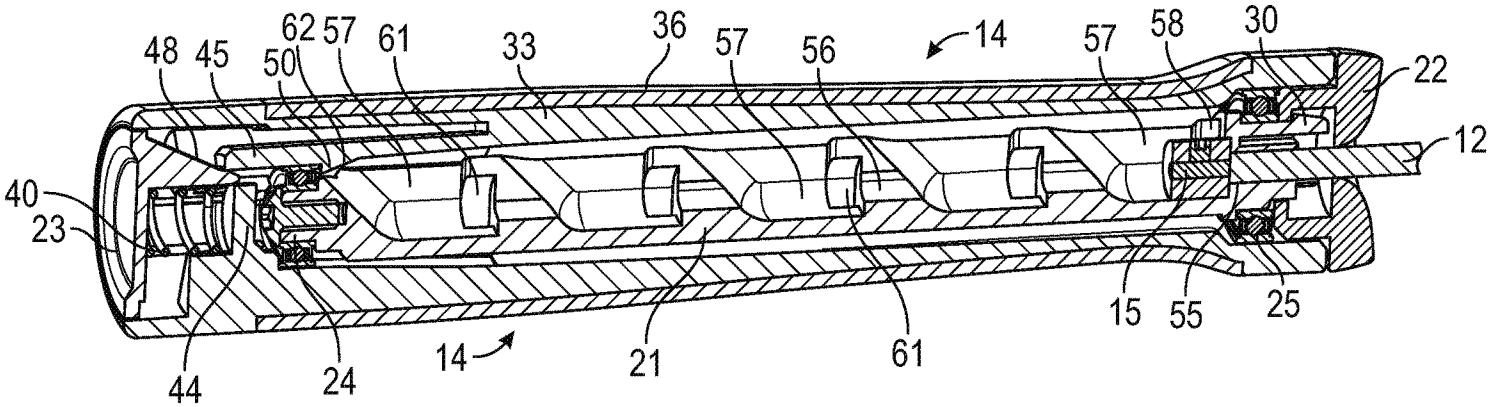
FIG. 16 is a cross-sectional view similar to FIG. 15 illustrating the cable secured in the longest jump rope length position.

Once the cable length is adjusted by the desired amount and the lug is secured in the appropriate seat 61, the stem 20 can be re-engaged in the outer sleeve or shell 16. The end of the stem assembly is inserted through open end 19 of sleeve 16 and the stem is then pushed into the sleeve until the outer end of the bearing 24 engages the tapered inner faces 62 of snap hooks 50, urging the hook outwards until the bearing clears the snap hooks 50, at which point the hooks snap inwards to engage the inner end face 64 of bearing 24 and latch the stem in the housing (see position of FIGS. 8 and 9). Spring 40 then biases end cap or push button 23 back out to the extended position of FIGS. 9, 14 and 15. FIGS. 14 and 15 illustrate the handle assembly 14 with the stem fully inserted and the cable secured at two different jump rope length positions. FIG. 14 illustrates the cable lug 15 secured at the last or innermost position or seat 61, defining the shortest cable length. FIG. 15 illustrates the cable lug 15 secured at the seat 61 in stem body 21 adjacent the cable inlet opening 55, corresponding to the longest jump rope length.

Figure 17:
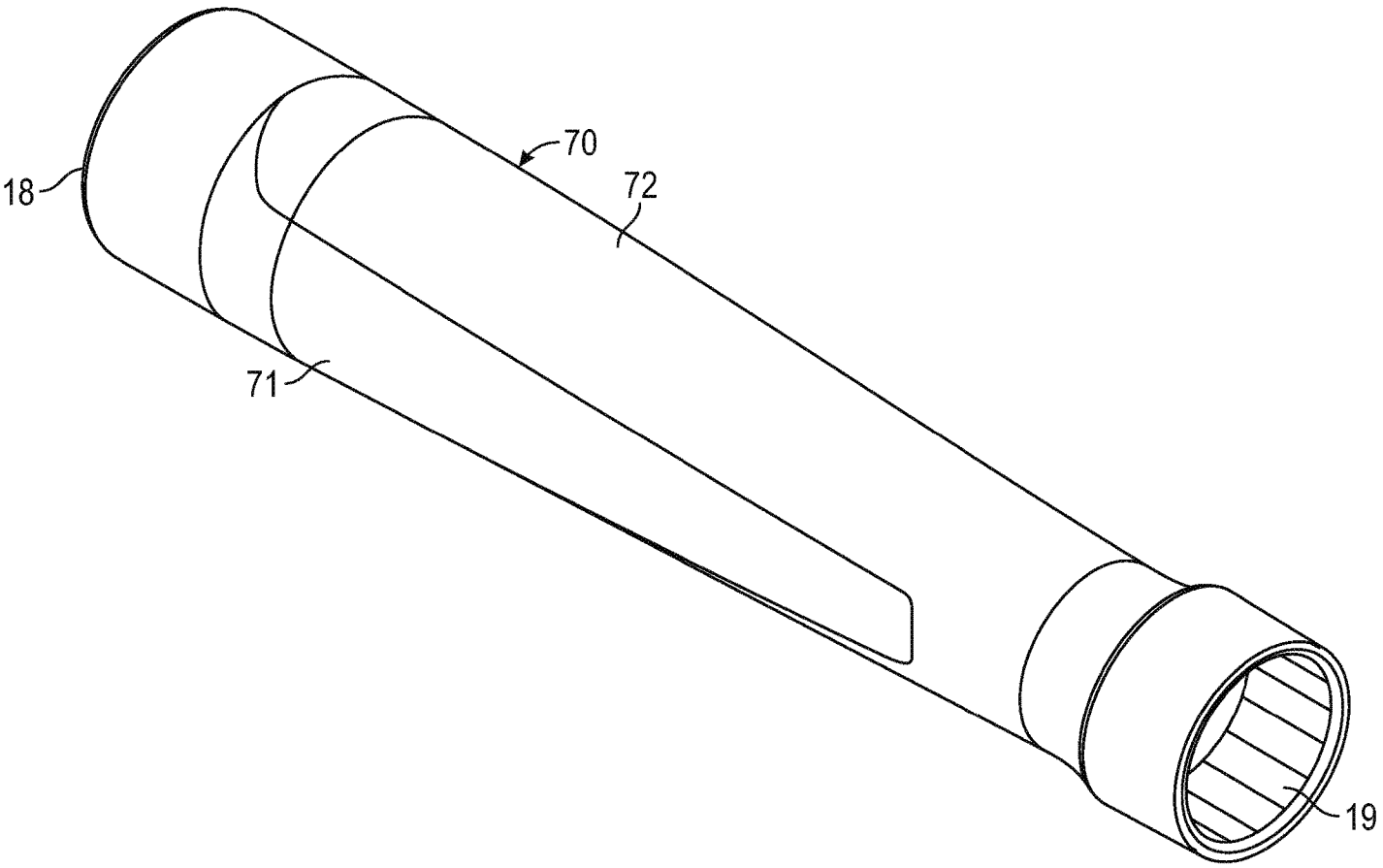
FIG. 17 is a perspective view of a modified handle casing or outer sleeve of more tapered shape than the handle sleeve of FIGS. 1 to 16.
Figure 18:
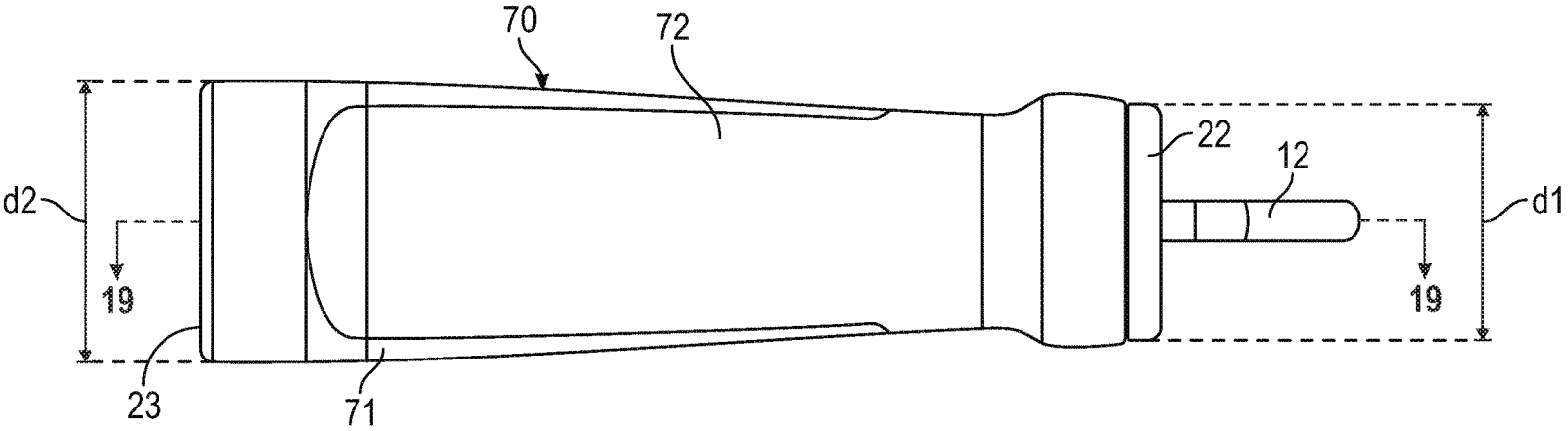
FIG. 18 is a top plan view of the assembled adjustable jump rope handle with the modified handle sleeve of FIG. 17.
Figure 19:
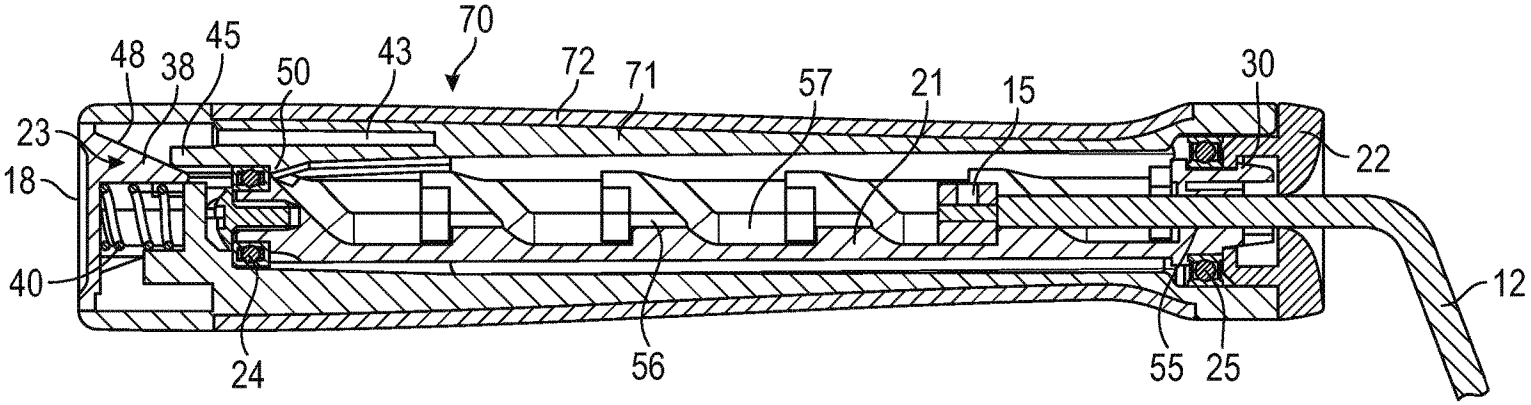
FIG. 19 is a cross-sectional view on the lines 19-19 of FIG. 18.

FIGS. 17 to 19 illustrate a modified adjustable jump rope handle which is similar to the previous embodiment but which has an outer handle body or sleeve 70 of a different, more tapered external shape. Apart from the change in external shape of handle sleeve 70, the adjustable handle is identical to that of the foregoing embodiment, and like reference numbers are used for like parts. As in the previous embodiment, the sleeve has a main body 71 of a first material with an indented region for receiving grip insert 72, as best seen in FIG. 19. Grip insert 72 is of larger size and of a different peripheral shape from the smaller grip inserts 35 of the previous embodiment, as seen in FIGS. 17 and 18.

Handle sleeve 70 has a generally outwardly tapered shape from open end 19 which receives the end cap 22 and rope or cable end portion, and outer end 18 in which the push button is engaged when the parts of the handle are assembled as in FIGS. 18 and 19. In one embodiment, the diameter d1 of open end 19 is around 25.5 mm and the diameter d2 of end 18 is around 30 mm.

As noted, all other parts of the adjustable jump rope handle and the internal shape and dimensions of the handle sleeve are identical to corresponding parts of the previous embodiment, and reference is made to the previous embodiment in connection with these parts and the adjustment method for changing the length of the rope or cable extending between two handles.

It will be understood that the cable adjustment mechanism of the previous embodiments is just one example of many different possible quick release and cable adjustment mechanisms for jump rope handle assemblies to allow for quick and easy jump rope length adjustment in the manner described above. For example, a cable lug retainer of different design may be used in other embodiments, such as a series of spaced walls or baffles in channel or groove 54. The retention mechanism for holding the stem in the handle shell in the illustrated embodiment is similar to a magazine clip for a rifle, but other releasable latching mechanisms may be used in other embodiments. For example, instead of a push button release at the distal end of the handle, the end cap 22 at the opposite end of the channel may be a releasable snap fit in the proximal end of the handle, or may be held in place by a suitable releasable latching mechanism such as a spring loaded pop pin on the outer surface of the outer shell, or other suitable mechanisms of the like, for example the latching mechanism found on telescoping collapsible umbrella handles.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter that is broadly contemplated by the present invention. It is further understood that the scope of the present invention fully encompasses other embodiments that may become obvious to those skilled in the art and that the scope of the present invention is accordingly limited by nothing other than the appended claims.

What is claimed:

1. An adjustable jump rope, comprising:

first and second handles;

a cable extending between the handles and having opposite first and second end portions associated with the respective first and second handles;

at least one of the handles comprising a handle sleeve having opposite first and second ends and an adjustment mechanism in the sleeve for releasably securing a selected length of the associated cable end portion inside the handle sleeve, whereby the length of rope extending between the handles is adjusted; and wherein the adjustment mechanism comprises an elongate stem telescopically engaged through the second end of the handle sleeve and a latching device for releasably retaining the stem in the handle sleeve, the elongate stem having a releasable retention device for releasably securing a series of different cable lengths to the stem.

2. The adjustable jump rope of claim 1, further comprising a retention head at each end of the cable, the stem having an open channel extending along at least part of its length configured to receive the cable, the releasable retention device comprising a series of spaced retention seats in the channel for releasable engagement with the respective retention head.

3. The adjustable jump rope of claim 2, where each adjacent pair of retention seats is spaced apart by a spacing of approximately one inch.

4. The adjustable jump rope of claim 3, wherein there are five spaced retention seats in the channel.

5. The adjustable jump rope of claim 1, further comprising a retention member at each end of the cable, each stem having opposite first and second ends and an elongate channel for receiving a selected length of the respective cable end portion extending along at least part of the length of the stem between the first and second ends of the stem, and a series of spaced retention formations along the length of the channel for releasably engaging the respective retention member to retain the selected length of cable in the channel.

6. The adjustable jump rope of claim 5, further comprising an end cap at the second end of the stem for releasable engagement in the second, open end of the handle sleeve when the stem is fully engaged in the handle sleeve.

7. The adjustable jump rope of claim 1, wherein the stem and cable are rotatably mounted in the handle sleeve for rotation about the longitudinal axis of the stem.

8. The adjustable jump rope of claim 7, wherein the stem comprises a stem body and first and second bearings at opposite first and second ends of the stem coupled to opposite ends of the stem body and comprising rotatable couplings between the handle sleeve and the stem body when the stem is retained in the handle sleeve, whereby the stem and attached cable are rotatable relative to the handle sleeve.

9. The adjustable jump rope of claim 1, wherein each stem has first and second ends and is configured for engagement into the handle sleeve through the second end of the handle sleeve into a fully engaged position, and the latching device comprises releasably engageable first and second latching formations in the handle sleeve and on the stem, respectively, the latching formations being configured for snap engagement when the stem is fully engaged in the handle sleeve with the second end of the stem adjacent the second, open end of the handle sleeve.

10. The adjustable jump rope of claim 9, wherein the first latching formation comprises a plurality of circumferentially spaced latch members on an inner surface of the handle sleeve which are moveable between a first, operative position for engagement with the second latching formation on the stem and a second, inoperative position spaced radially outwards from the first, operative position to release the stem, the latch members being biased towards the first, operative position.

11. The adjustable jump rope of claim 9, further comprising a manually operable quick release device associated with the handle sleeve and configured to release the stem from the latching formation in the handle sleeve, whereby the stem can be removed from the handle sleeve.

12. The adjustable jump rope of claim 11, wherein the quick release device comprises a push button engaged in the first end of the handle sleeve and movable between an extended, inoperative position and a depressed, operative position spaced inward from the first end of the handle sleeve and engaging the latching formation in the handle sleeve to release the latching formation from the stem and allow removal of the stem from the handle sleeve.

13. The adjustable jump rope of claim 12, further including a biasing spring configured to urge the push button into the extended, inoperative position.

14. The adjustable jump rope of claim 13, wherein the first latching formation comprises a plurality of circumferentially spaced, flexible clips extending along an inner surface of the sleeve towards the first end of the sleeve and each having a hook member configured to engage the second latching formation comprising an opposing surface of the stem when the stem is fully engaged in the handle sleeve, each clip being movable in a radial direction between an inner, latching position and an outer, released position spaced radially outward from the inwardly facing surface of the stem, and being biased towards the inner, latching position.

15. The adjustable jump rope of claim 14, wherein the push button has an outer wall having an inner face and a plurality of spaced fingers extending inwardly from the inner face into the handle sleeve, each finger having an outer tapered surface and being aligned with a respective clip, each clip having an outer end engaging the tapered surface of the respective finger, whereby the fingers are urged outwards to release the stem when the push button is pushed inwards into the handle sleeve.

16. The adjustable jump rope of claim 13, wherein the handle sleeve has a seat facing outwards towards the push button and the biasing spring extends between the inner face of the push button and the seat.

17. A method of adjusting the length of a jump rope extending between two handles, comprising:

releasing a latch mechanism which retains a removable stem inside an outer sleeve of a handle of a jump rope having a first length of jump rope extending between the handles;

removing the stem from the outer sleeve of the handle;

releasing an end part of the jump rope from a first retention device in the stem holding the end part and a length of jump rope extending from the end part in the stem;

engaging the end part with a different retention device in the stem whereby a different length of the jump rope is held in the stem;

inserting the stem back into the outer sleeve and into latching engagement with the latch mechanism, whereby a second, different length of the jump rope extends between the handles; and repeating the foregoing steps in order to shorten or lengthen the amount of jump rope extending between the handles.

18. The method of claim 17, wherein the step of releasing the latch mechanism comprises depressing a quick release push button associated with the handle and the step of removing the stem from the handle sleeve comprises pulling cable extending out of the stem away from the handle sleeve.

19. The method of claim 17, wherein the end part of the jump rope comprises an enlarged retention head and the step of releasing an end part of the jump rope comprises moving an enlarged retention head out of a matching retention seat of a plurality of spaced retention seats in an elongate channel in the stem.

20. The method of claim 19, wherein the step of engaging the end part with a different retention device comprises aligning the retention head with a selected different retention seat in the channel and pulling a length of cable extending out of the stem away from the stem until the retention head is engaged with the retention seat.

* * * * *